US005262764A

United States Patent [19]

Inamori et al.

[11] Patent Number: 5,262,764

[45] Date of Patent: Nov. 16, 1993

[54] DISPLAY CONTROL CIRCUIT

[75] Inventors: Yoshimitsu Inamori, Nara; Koichi Oda, Sakai, both of Japan

[73] Assignee: Sharp Kabushiki Kaisha, Osaka, Japan

[21] Appl. No.: 740,585

[22] Filed: Aug. 5, 1991

[30] Foreign Application Priority Data

Aug. 10, 1990 [JP] Japan ..... 2-213162

[51] Int. Cl.[5] ..... G09G 1/06

[52] U.S. Cl. ..... 345/115; 345/119

[58] Field of Search ..... 340/721, 723, 724, 716; 395/157, 164, 166, 721, 723

[56] References Cited

U.S. PATENT DOCUMENTS 4,554,538 11/1985 Bieneman ..... 340/721
4,710,761 12/1987 Kapur et al. ..... 340/723
4,769,762 9/1988 Tsujido ..... 340/716
4,954,819 7/1990 Watkins ..... 340/721

FOREIGN PATENT DOCUMENTS 250680 11/1986 Japan .
114319 4/1990 Japan .
247737 10/1990 Japan .

*Primary Examiner*—Ulysses Weldon
*Assistant Examiner*—Matthew Luu
*Attorney, Agent, or Firm*—Nixon & Vanderhye

[57] ABSTRACT

A display control circuit includes a window coordinate data memory for storing window coordinate data which specifies a window region in a display region of a displaying device for displaying an image in accordance with address data and display data, a mask data generator for generating mask data for distinguishing the window region from the display region in accordance with the address data and the window coordinate data, and an operating device for generating display data input to the displaying device by operating the mask data and the display data corresponding to every address data input to the displaying device.

9 Claims, 8 Drawing Sheets

DISPLAY CONTROL CIRCUIT

BACKGROUND OF THE INVENTION

1. Field of the Invention

The present invention relates to a display control circuit which provides a window display in displaying means such as a liquid crystal display.

2. Description of the Prior Art

A liquid crystal display is largely used in an electronic device such as a small-sized computer or a word processor for Japanese and a window function is used in a display region of the liquid crystal display in order to increase display information. The window function is a function for displaying different display data in a specific display region (referred to as a window region hereinafter) set in the already displayed display screen. There are some cases where the window regions are set in a plurality of positions in the single display region and also there are some cases where another window region is superposed on the already displayed window display region.

In order to implement the above window function, it is necessary to delete an already displayed image in the window region when the window region is set and display the different display information in the window region. In this operation, a large amount of address operation is required. This address operation was performed by software operation through a CPU (central processing unit) comprised in the word processor for Japanese or the like in the prior art. This software operation requires high-speed operation of the CPU. Therefore, it is necessary to supply a relatively large power to the CPU. Although the high-speed address operation by the software is possible in the electronic device which is connected to a commercial ac supply, the high-speed operation of the CPU is difficult in the electronic device which is driven by a battery because a relatively small power is applied to the CPU in that device. Therefore, it is difficult to implement the window function.

SUMMARY OF THE INVENTION

The present invention provides a display control circuit which comprises window coordinate data storing means for storing window coordinate data which specifies a window region in a display region of displaying means for displaying an image in accordance with address data and display data, mask data generating means for generating mask data for distinguishing the window region from the display region in accordance with the address data and the window coordinate data and operating means for generating display data input to the displaying means by operating the mask data and the display data corresponding to every address data input to the displaying means. The mask data generating means may comprise substracting means for operating a difference between the address data and the window coordinate data and then generate the mask data in accordance with the difference. In addition, it is preferable that the address data and the display data are supplied from a CPU. Further, it is preferable that the displaying means is liquid crystal display.

Further, the address data and window coordinate data may be shown in X-Y rectangular coordinates set in the display region.

Preferably, the window region is rectangular and the window coordinate data is designated by coordinates $(X_1, Y_1)$ and $(X_2, Y_2)$ of two opposite tops in the window region.

It is preferable that the mask data generating means comprises subtracting means for operating a difference between the address data (X, Y) and the window coordinate data $(X_1, Y_1)$ and $(X_2, Y_2)$ and generates the mask data which shows that the address data (X, Y) exists in the window region when $X_1>X_2$, $Y_1>Y_2$ and $X_1>X>X_2$, $Y_1>Y>Y_2$.

DETAILED DESCRIPTION OF THE PREFERRED EMBODIMENTS

Figure 1:
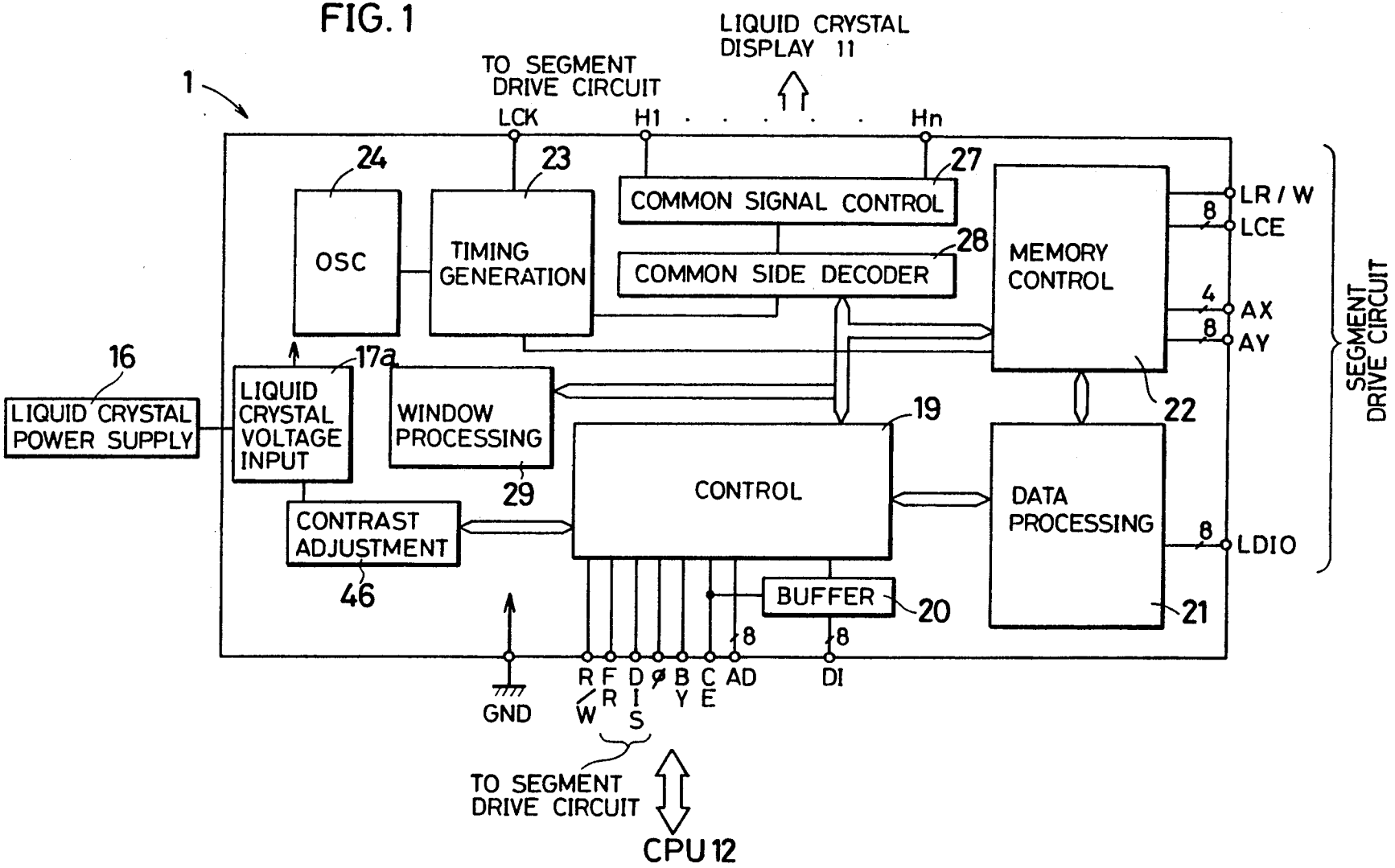
FIG. 1 is a block diagram showing a common drive circuit 1 in accordance with an embodiment of the present invention.
Figure 2:
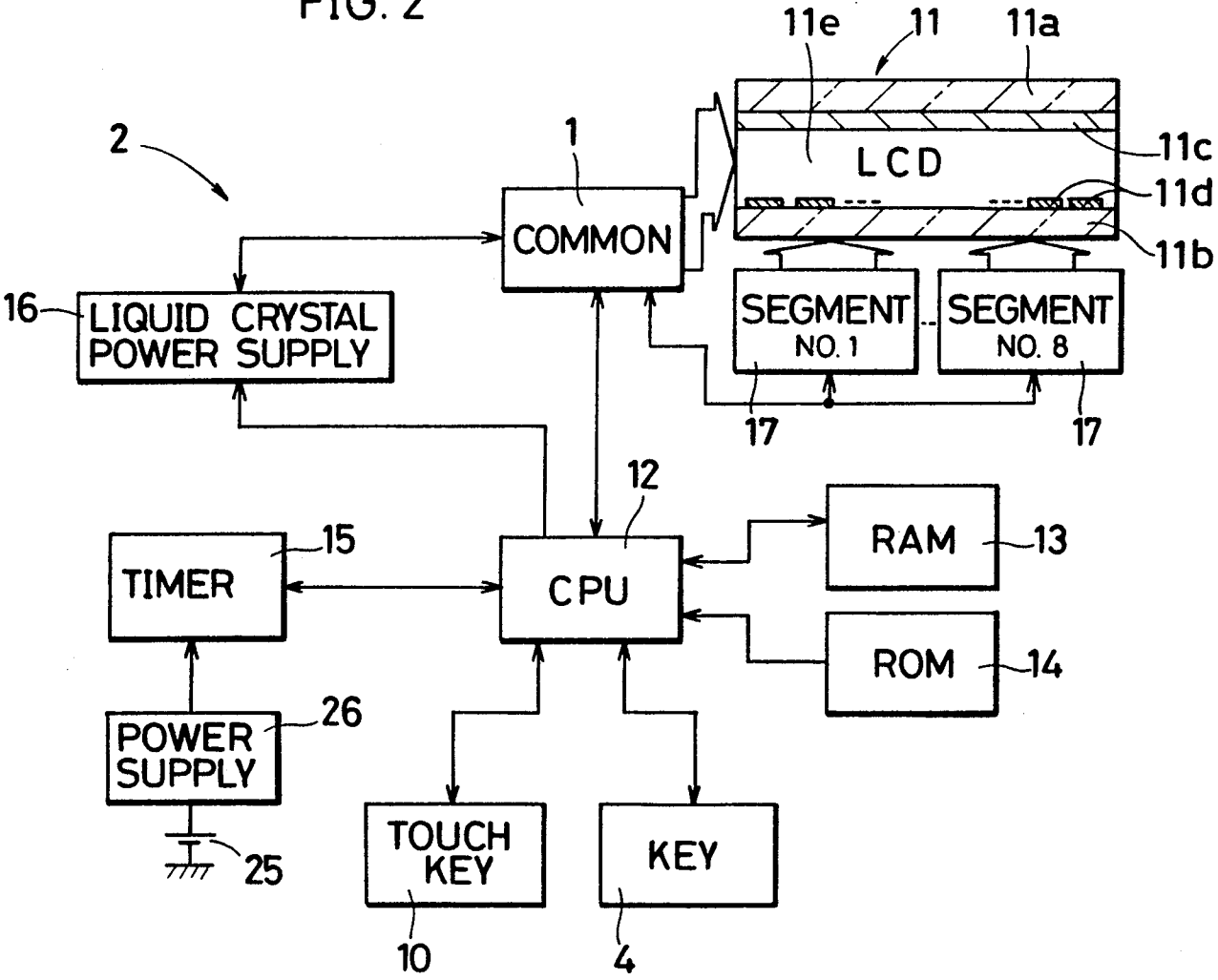
FIG. 2 is a block diagram showing a data processor 2.
Figure 3:
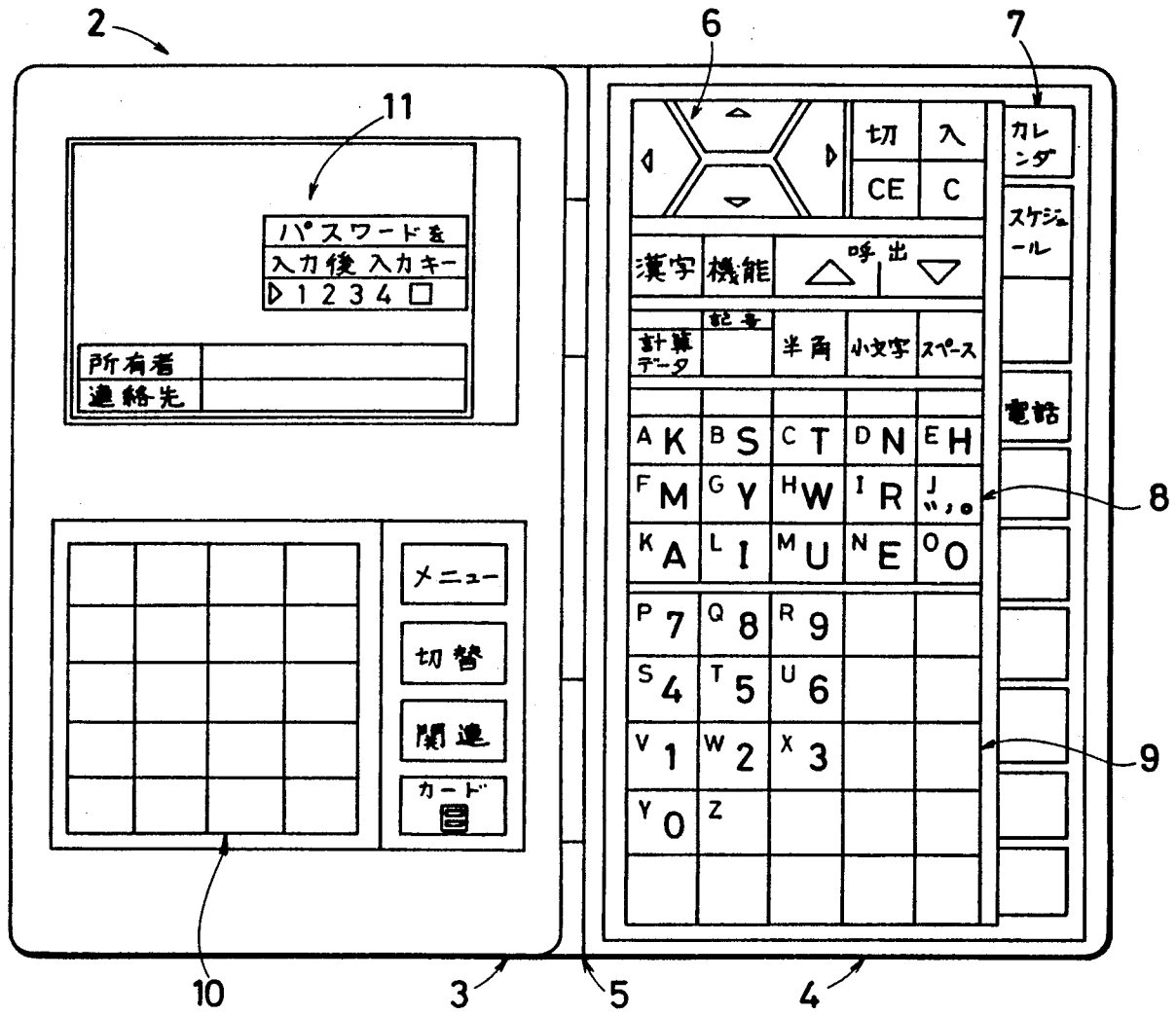
FIG. 3 is a plan view showing the data processor 2.

FIG. 1 is a block diagram showing a structure in accordance with an embodiment of the present invention, FIG. 2 is a block diagram showing a data processor 2 in which a common drive circuit 1 is used and FIG. 3 is a plan view showing the data processor 2. The data processor 2 is about the size of a pocketbook in which a first operation part 3 is connected to a second operation part 4 at a connection part 5 in an openable manner. The second operation part 4 comprises a cursor key part 6, a function set key part 7, a character input key part 8 and a numeral key part 9. The first operation part 3 comprises a so-called transparent touch key part 10 and a liquid crystal display 11.

The above described data processor 2 comprises a CPU (central processing unit) 12 including, for example a micro processor. The transparent touch key part 10 and each key input means of the second operation part 4 are connected to the CPU 12. In addition, to the CPU 12 connected are a RAM (random access memory) 13 used as a working region of data at the time of storing or operation of various input data and a ROM (read only memory) 14 in which a program for specifying control operation of the CPU 12, font data for display, calendar data or the like is stored. Further, to the CPU 12 connected are a timer circuit 15, the common drive circuit 1 which controls display operation of the liquid crystal display 11 as will be described later and a liquid crystal power circuit 16 which changes a liquid crystal supply potential supplied to the common drive circuit 1 in accordance with a contrast signal from the common drive circuit 1 and switches an operating state to a stopped state or other way about by a control signal from the CPU 12. A plurality of segment drive circuits 17 (eight in this embodiment) are connected to the common drive circuit 1, which controls a display state of the liquid crystal display 11 with the common drive circuit 1. In the liquid crystal display 11, a common electrode 11c and a segment electrode 11d are formed on a pair of transparent substrates 11a and 11b, respectively and a liquid crystal layer 11e is formed between them.

A block diagram of the common drive circuit 1 is shown in FIG. 1. The common drive circuit 1 comprises a control circuit 19 to which a write/read control signal R/W, a clock signal $\phi$, a busy signal BY and a chip enable signal CE are input from the CPU 12 and also to which address data AD and display data DI are input. The display data DI is input through a buffer 20. In addition, a frame signal FR, a control signal DIS which controls ON/OFF of display formed by the segment electrode, a clock signal LCK are output from the common drive circuit 1 to the segment drive circuit 17. As described above, the data processor 2 is about the size of the pocketbook and various reference voltages required for operation of the data processor 2 are generated from the power circuit 26 connected to a battery 25.

A data processing circuit 21 is connected to the control circuit 19 and performs logical operation (SET, AND, OR, XOR or the like) which is predetermined in address data or display data input from the CPU 12 and then outputs the data to the segment drive circuit 17. The memory control circuit 22 determines to which segment drive circuit 17 the address data input from the CPU 12 is to be output and then generates a relative address in any selected segment drive circuit 17. A timing generation circuit 23 generates a clock signal used for various operations in the common drive circuit 1 and receives a reference clock signal from the oscillator 24.

A common signal control circuit 27 and a common side decoder 28 generate a common signal to be output to the common electrode of the liquid crystal display 11 by using the clock signal generated in the timing generation circuit 23. In addition, the control circuit 19 is connected to a window processing circuit 29 whose structure and operation are to be described later. A contrast adjustment circuit 46 stores a concentration of display in the liquid crystal display 11 and its concentration data is set by the CPU 12. The contrast adjustment of the liquid crystal display 11 is performed in the liquid crystal power circuit 16 shown in FIG. 2 in accordance with the concentration data in the contrast adjustment circuit 48. A liquid crystal voltage input part 17a takes the liquid crystal supply potential from the liquid crystal power circuit 16 into the common drive circuit 1.

Figure 4:
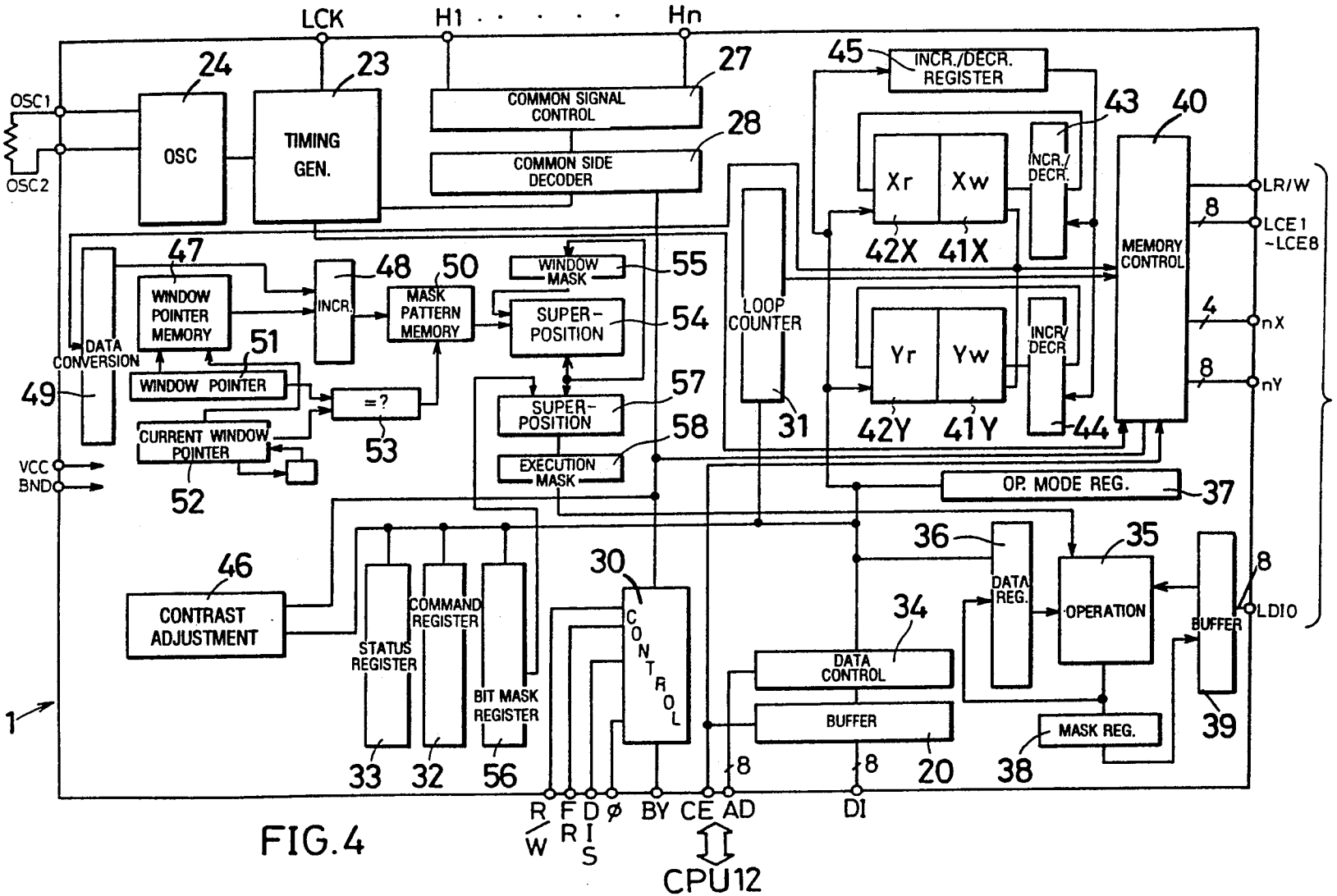
FIG. 4 is a block diagram showing an example of a structure of the common drive circuit 1.

FIG. 4 is a block diagram showing a specific structure of the common drive circuit 1. A control part 30, a loop counter 31, a command register 32, status register 33 and a data control circuit 34 form the control circuit 19 shown in FIG. 1. The control part 30 controls the whole common drive circuit 1 and the loop counter 31 counts how many times the command data set in the command register 32 from the CPU 12 runs in succession. The status register 33 stores the operation state at the present time of the common drive circuit 1. Thus, when the CPU 12 reads the contents of the status register 33, the CPU 12 can detect the operation state of the common drive circuit 1. The data control part 34 controls transmission/reception of data with the CPU 12 through the buffer 20.

An operation circuit 35, a data register 36, an operation mode register 37 and a mask register 38 forms the data processing circuit 21 shown in FIG. 1. The operation circuit 35 performs various logical operations (SET, OR, AND, XOR or the like) which are specified by the operation mode register 37 between data input from the CPU 12 and stored in the data register 36 and the segment data to be described later. In a case where the operation state of the common drive circuit 1 is in the write state in which data is transmitted to the segment drive circuit 17, the obtained data is transmitted to the segment drive circuit 17. In a case where it is in the read state in which the data is transmitted to the CPU 12, the data is transmitted to the CPU 12 through the data control part 34.

At this time, the operation processing is sometimes masked depending on data in the mask register 38. More specifically, a case where the operation is not performed is set. In addition, execution mask data obtained in the window processing circuit 29 as will be described later is masked in accordance with the data of the same register 38.

The memory control circuit 22 comprises write address registers 41X and 41Y and read address registers 42X and 42Y. When the write address (XW, YW) or the read address (XR, YR) of data stored therein is stored as absolute address from the CPU 12, the memory control part 40 outputs selective signals LCE 1 to LCE 8 which selects one of eight segment drive circuits 17 shown in FIG. 2 and also outputs control signal LR/W which sets either the write state or read state in each segment drive circuit 17. Increment/decrement circuits 43 and 44 automatically increments and decrements by +8 or +1, respectively in accordance with specification of an increment/decrement register 45 after a command such as a write operation of the address data of the address registers 41X, 41Y, 42X and 42Y is performed.

The window processing circuit 29 comprises a window pointer memory 47 and stores a couple of two pairs of address data which specifies a plurality of rectangular window regions which are present in the liquid crystal display 11 by the number of the window regions. Data stored in the window pointer memory 47 is compared in the increment circuit 48 with data converted from the absolute address (XW, YW) and (XR, YR) stored in the address registers 41X, 41Y, 42X and 42Y by a data conversion circuit 49, whereby a mask pattern to be described later is formed and it is stored in the mask pattern memory 50.

As described above, a plurality of window regions are generally set in the liquid crystal display 11. Data telling where a display region where the present data is to be written or read is positioned in the window regions is stored in the window pointer 51 and window processing to be described later is continued every window region until a current window pointer 52 coincides with the data of the window pointer 51. When they coincide with each other, a coincidence circuit 53 outputs a completion signal of a mask pattern.

Superposition processing of the window mask pattern to be described later is performed in a first superposition part 54 and the obtained window mask pattern is stored in the window mask part 55. Superposition processing of the superposed window mask pattern obtained in the first superposition part 54 and a bit mask register 56 in which data can be specified every bit is performed in a second superposition part 57 and the finally obtained execution mask is stored in an execution mask part 58. The operation circuit 35 performs various logical operations between the execution mask 58 and the segment data from the buffer 39.

Figure 5:
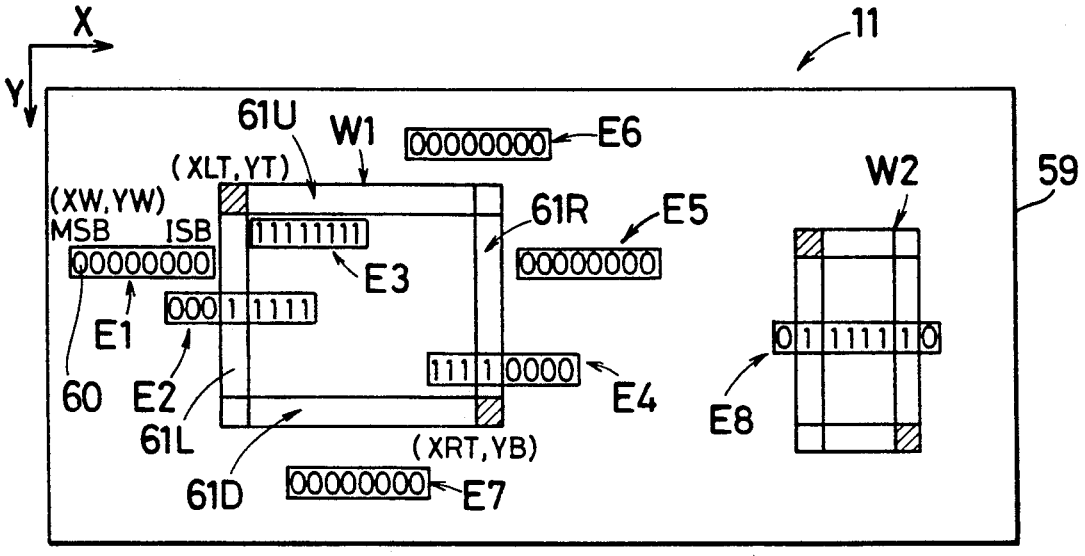
FIG. 5 is a view showing an example of display of a horizontally written mode.

FIG. 5 is a view showing an example of a horizontally written display in the display region 59 of the liquid crystal 11. For example, two window regions W1 and W2 are set in the display region 59. In this embodiment of the present invention, sixteen window regions can be set, which is shown by reference W as a whole. Each window region W is rectangular as shown in FIG. 5, which is specified by two couples of address data of address (XLT, YT) and address (XRT, YB) shown in FIG. 5. For example, sixteen couples of the above two pairs of address data are stored in the window pointer memory 47 corresponding to sixteen window regions.

When data is written or read from an access starting position 60 in the display region 59, the data is accessed every 8-bit display region Ei (i=1, 2, . . . ) in which the access starting position 60 is a most significant bit (MSB). When the data is written in the 8-bit display region E1 shown in FIG. 5 and displayed, address data XW and YW of the most significant bit of the corresponding data in an X direction and a Y direction, respectively are written in the write address registers 41X and 41Y from the CPU 12.

At this time, how the data contained in the display region E1 is superposed on the window region W1 is detected by performing the following one to four subtractions in the subtraction circuit 48.

| | | |
|---|---|---|
| Left | (XW + 8) - XLT | . . . (1) |
| Right | XRT - XW | . . . (2) |
| Upside | YW - YT | . . . (3) |
| Downside | YB - YW | . . . (4) |

The left, right, upside and downside of the window region W1, which are 61L, 61R, 61U and 61D, respectively, are compared with the display region E1 by the above subtractions (1) to (4) and the number of superposed bits is shown.

Therefore, for example, in a case of the display region E1 shown in FIG. 5, the result of the subtraction (1) is negative and then it is determined that the display region E1 is outside the left side 61L of the window region W1. In the same manner, it is determined that the display regions E5, E6, E7 are outside the right side 61R, the upside 61U and downside 61D of the window region W1, respectively. In this case, as a mask pattern referring to each of the display regions E1, E5, E6 and E7, [0 0 0 0 0 0 0 0] is obtained through processing to be described later.

Meanwhile, the result of the subtraction (1) referring to the display region E2 becomes "5" because the address XLT=XW+3 as shown in FIG. 5. Thus, the result of the subtraction (1) is classified into a case of a negative value, a case of 0 to 7 and a case of 8 or more. When the result is negative, the display region E1 is outside the left side 61L and a mask pattern of [0 0 0 0 0 0 0 0] is generated. When the result is 8 or more, the display region E1 is on the right side of the left side 61L and a mask pattern of [1 1 1 1 1 1 1 1] is generated.

Figure 6:
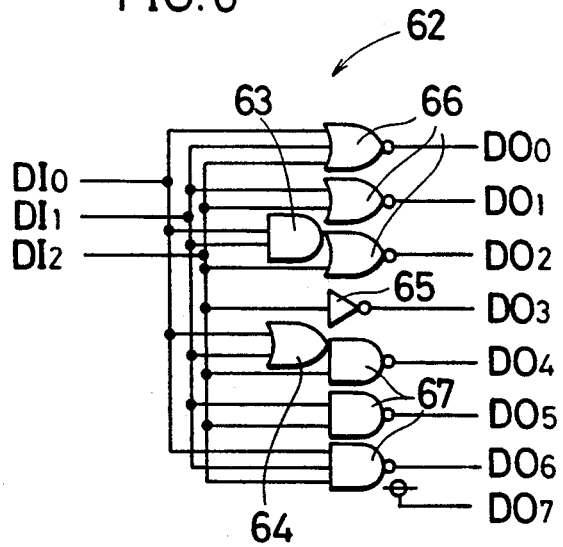
FIGS. 6 and 7 are views showing data conversion circuits 62 and 68, respectively.

When the result ranges from 1 to 7, a data conversion circuit 62 shown in FIG. 6 comprised in the subtraction circuit 48 is used. More specifically, the following operations of the equations (5) to (12) are performed referring to 3-bit outputs of the operation result DI2, DI1 and DI0 through an AND circuit 63, an OR circuit 64, a inverter circuit 65, three NOR circuits 66 and three NAND circuits 67 and then mask patterns DO7 to DO0 shown in a table 1 are obtained.

$$DO0=DI0+DI1+DI2 \quad (5)$$

$$DO1=DI1+DI2 \quad (6)$$

$$DO2=DI0\cdot DI1+DI2 \quad (7)$$

$$DO3=DI2 \quad (8)$$

$$DO4=(DI0+DI1)\cdot DI2 \quad (9)$$

$$DO5=DI1\cdot DI2 \quad (10)$$

$$DO6=DI0\cdot DI1\cdot DI2 \quad (11)$$

TABLE 1

| DI2 | DI1 | DI0 | DO7 | DO6 | DO5 | DO4 | DO3 | DO2 | DO1 | DO0 |
|---|---|---|---|---|---|---|---|---|---|---|
| 0 | 0 | 0 (0) | 1 | 1 | 1 | 1 | 1 | 1 | 1 | 1 |
| 0 | 0 | 1 (1) | 1 | 1 | 1 | 1 | 1 | 1 | 1 | 0 |
| 0 | 1 | 0 (2) | 1 | 1 | 1 | 1 | 1 | 1 | 0 | 0 |
| 0 | 1 | 1 (3) | 1 | 1 | 1 | 1 | 1 | 0 | 0 | 0 |
| 1 | 0 | 0 (4) | 1 | 1 | 1 | 1 | 0 | 0 | 0 | 0 |
| 1 | 0 | 1 (5) | 1 | 1 | 1 | 0 | 0 | 0 | 0 | 0 |
| 1 | 1 | 0 (6) | 1 | 1 | 0 | 0 | 0 | 0 | 0 | 0 |
| 1 | 1 | 1 (7) | 1 | 0 | 0 | 0 | 0 | 0 | 0 | 0 |

In the equation (2) which compares the right side 61R of the window region W1 with the display region E, the result of the operation is classified into a case of a negative value, a case of 0 to 7 and a case of 8 or more like the subtraction (1). When the result is negative, the display region is outside the right side 61R as shown by E5 in FIG. 5 and a mask pattern of [0 0 0 0 0 0 0 0] is generated. When the result is 8 or more, the display region E3 is on the left side of the right side 61R and a mask pattern of [1 1 1 1 1 1 1 1] is generated.

Figure 7:
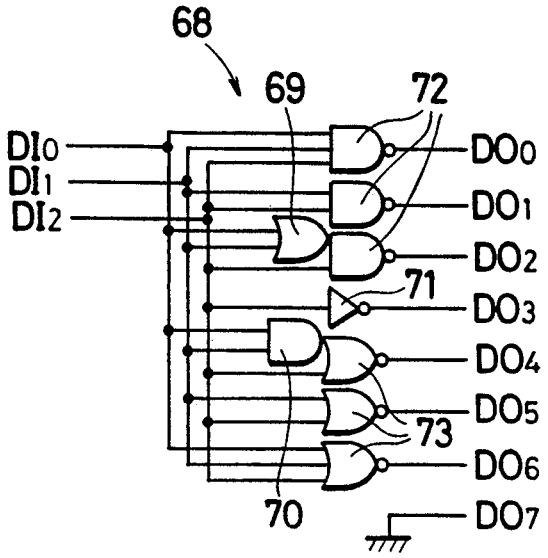

When the result ranges from 1 to 7, a data conversion circuit 68 shown in FIG. 7 comprised in the subtraction circuit 48 is used. The following operations of the equations (13) to (20) are performed referring to the 3-bit data DI2, DI1 and DI0 through an OR circuit 69, and AND circuit 70, a reverse circuit 71, three NAND circuits 72 and NOR circuits 73.

$$DO0=DI0\cdot DI1\cdot DI2 \quad (13)$$

$$DO1=DI1\cdot DI2 \quad (14)$$

$$DO2 = \overline{DI0\cdot DI2 + DI1\cdot DI2} = \overline{(DI0+DI1)\cdot DI2} \quad (15)$$

$$DO3=DI2 \quad (16)$$

$$DO4=DI0\cdot DI1+DI2 \quad (17)$$

$$DO5=DI1+DI2 \quad (18)$$

$$DO6 = DI0 + DI1 + DI2 \quad (19)$$

$$DO7 = 1 \quad (20)$$

Thus, outputs DO7 to DO0 of the mask patterns shown in the following table 2 are obtained.

TABLE 2

| DI2 | DI1 | DI0 | DO7 | DO6 | DO5 | DO4 | DO3 | DO2 | DO1 | DO0 |
|---|---|---|---|---|---|---|---|---|---|---|
| 0 | 0 | 0 (0) | 0 | 1 | 1 | 1 | 1 | 1 | 1 | 1 |
| 0 | 0 | 1 (1) | 0 | 0 | 1 | 1 | 1 | 1 | 1 | 1 |
| 0 | 1 | 0 (2) | 0 | 0 | 0 | 1 | 1 | 1 | 1 | 1 |
| 0 | 1 | 1 (3) | 0 | 0 | 0 | 0 | 1 | 1 | 1 | 1 |
| 1 | 0 | 0 (4) | 0 | 0 | 0 | 0 | 0 | 1 | 1 | 1 |
| 1 | 0 | 1 (5) | 0 | 0 | 0 | 0 | 0 | 0 | 1 | 1 |
| 1 | 1 | 0 (6) | 0 | 0 | 0 | 0 | 0 | 0 | 0 | 1 |
| 1 | 1 | 1 (7) | 0 | 0 | 0 | 0 | 0 | 0 | 0 | 0 |

When the result of the subtractions (3) and (4) are 0 or more, the address (XW, YW) in the access starting postion 60 is below the upwide 61U or above the downside 61D of the window region W1.

When the result of the subtraction (1) is positive and the result of the subtraction (2) is negative like the display region E8 shown in FIG. 5, an intermediate pattern [1 0 0 0 0 0 0 0 ] obtained from the result of the subtraction (1) and an intermediate pattern [0 0 0 0 0 0 0 1 ] obtained from the result of the subtraction (2) are provided and then a logical operation is performed on intermediate patterns [0 1 1 1 1 1 1 1 ] and [1 1 1 1 1 1 1 0 ] which are obtained by reversing the above intermediate patterns and then a mask pattern [0 1 1 1 1 1 1 0 ] shown in FIG. 5 is obtained.

Figure 8:
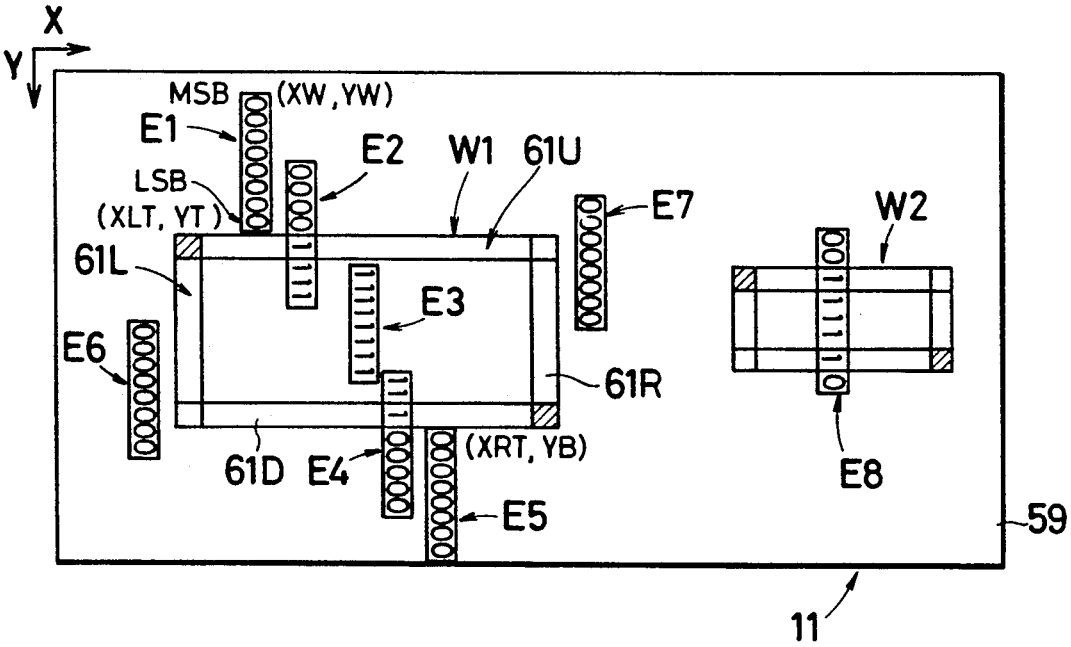
FIG. 8 is a view showing an example of display of a vertically written mode.

FIG. 8 is a view showing an example of a display in a vertically written mode. It is also assumed that the window regions W1 and W2 are set in this display example. The above-described subtraction of the window data (XLT, YT), (XRT, YB) which specify the window region W1 and the display region E1 where the most significant bit has the address (XW, YW) is performed on the basis of the following subtractions (21) to (24).

| | | |
|---|---|---|
| Left | XW - XLT | . . . (21) |
| Right | XRT - XW | . . . (22) |
| Upside | (YW + 8) - YT | . . . (23) |
| Downside | YB - YW | . . . (24) |

Processing of the result of the subtractions (21) and (22) are the same as that of the result of the subtractions (3) and (4). In addition, processing of the substractions (23) and (24) are the same as that of the substractions (1) and (2).

More specifically, the result of the subtraction (23) is negative in a case of the display region E1 and then an intermediate pattern [1 1 1 1 1 1 1 1 ] is obtained. Then, a mask pattern [0 0 0 0 0 0 0 0 ] is obtained by reversing the above pattern. In a case where the result of the operation ranges from 0 to 7, the substractions (5) to (12) are performed referring to the 3-bit data DI0, DI1 and DI2 showing these values and then the results shown in the table 1 are obtained and reversed. Thus, the mask patterns shown in the display regions E2 and E3 are obtained.

In a case where the result is 8 or more, the display region is inside the window region W1 as shown by E3 and an intermediate pattern [0 0 0 0 0 0 0 0] is obtained, which are reversed and then the mask pattern [1 1 1 1 1 1 1 1] is obtained.

Comparison with the downside 61D is made in the subtraction (24). When the result of the operation is negative, the region is all outside the region like the display region E5 and the intermediate pattern [1 1 1 1 1 1 1 1] is obtained and then the mask pattern [0 0 0 0 0 0 0 0] is obtained by reversing the intermediate pattern. When the result of the operation ranges from 0 to 7, operations (13) to (20) are performed and then 8-bit operation results shown in the table 2 are provided. In a case of the display region E4, the result of the operation is "2" and then the intermediate pattern [0 0 0 1 1 1 1 1] is obtained from the table 2 and it is reversed, whereby the mask pattern [1 1 1 0 0 0 0 0] is obtained. When the result of the operation is 8 or more, the region is all inside the region like the display region E3.

Figure 9:
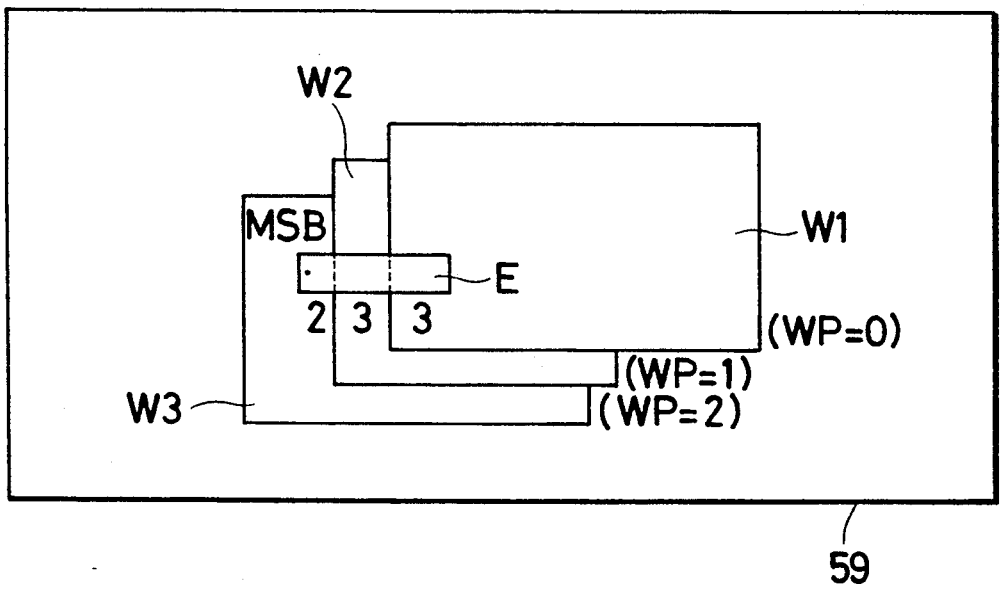
FIG. 9 is a view showing a state where a plurality of window regions W are superposed.

FIG. 9 is a view showing the display region 59 of the liquid crystal display 11 shown in FIG. 2, in which a plurality of window regions W1, W2 and W3 are superposed. A value of a window pointer WP of the window region W stored in the window pointer register 51 shown in FIG. 4 increases its number from the top of the superposed window regions W. More specifically, the value of the window pointer WP is 0, 1 and 2 corresponds to the window regions W1, W2 and W3, respectively as shown in FIG. 9.

Figure 10:
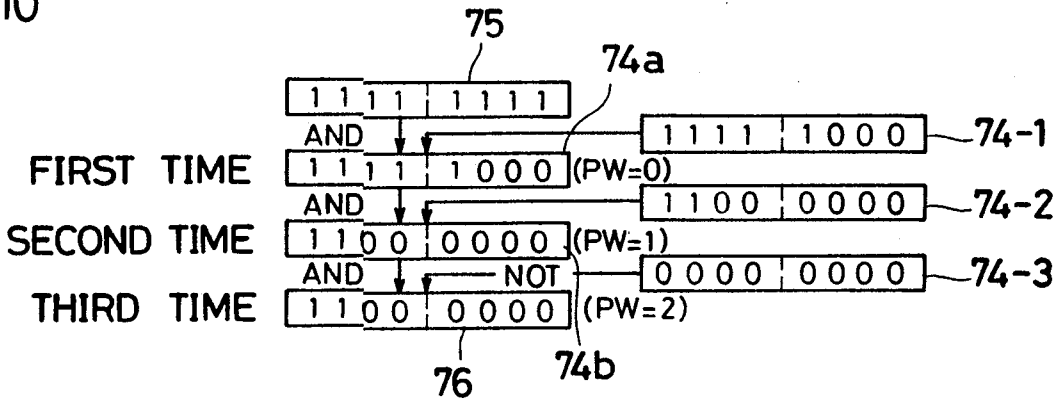
FIGS. 10 to 12 are views showing operation for forming a mask pattern 76.
Figure 11:
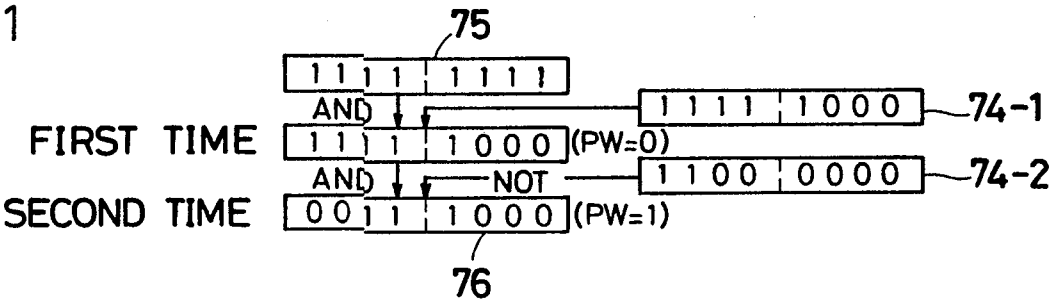
Figure 12:
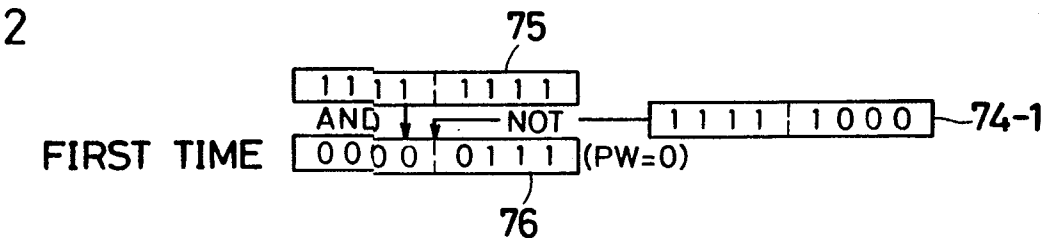

FIGS. 10 to 12 are views showing operation for writing the display region E into the display region 59, in which two bits containing the most significant bit belong to the window region W3, the following three bits belong to the window region W2 and the following three bits containing the least significant bit belong to the window region W1. As shown in FIG. 10, a reference pattern 75 in which all bits are "1" is prepared in the window mask part 55 shown in FIG. 4 and the intermediate pattern 74-1 of the display region E referring to the window region W1 is formed through the above-described processing. These are superposed in the first superposition part 54 by logical product.

Thus obtained intermediate pattern **74*a* is stored in the window mask part 55 again and the intermediate pattern 74-2 referring to the display region E is formed in the window region W2. This is superposed on the intermediate pattern 74*a* in the first superposition part 54 again by logical product and then the intermediate pattern 74*b* is obtained. In addition, the intermediate pattern 74-3 is formed referring to the window region W3 and a reversed pattern of the intermediate pattern 74-3 is superposed on the intermediate pattern 74*b* at the first superposition part 54. Thus, the final mask pattern 76** is obtained.

FIG. 11 is a view showing a case where data is written or read in the third to fifth bits from the window region W2 of the display region E shown in FIG. 9 in which the window pointer WP is set at 1 in the current window pointer 52 shown in FIG. 4. Referring to the display region E and the window region W1, for example the intermediate pattern 74-1 is formed and stored in the mask pattern memory 50. Then, referring to the window region W2, for example the intermediate pattern 74-2 is formed and its reversed pattern is stored in the mask pattern memory 50. Thereafter, the intermediate pattern 74-1 are repetitively superposed on the reversed pattern of the intermediate pattern 74-2 to the reference data 75 in the superposition part 54. As a result, the final mask pattern 76 is provided.

FIG. 12 is a view showing writing operation into a part corresponding to the window region W1 in the display region E shown in FIG. 9. The intermediate pattern 74-1 referring to the window region W1 is formed and its reversed pattern is stored in the mask pattern memory 50. Then, the reference pattern 75 is superposed on the reversed pattern by logical product in the first superposition part 54 and then the mask pattern 76 is provided.

As described above, according to this embodiment of the present invention, a plurality of window regions E are set in the display region 59 of the liquid crystal display 11 and display is written or display data is read every window region E by a hardware having a circuit structure shown in FIGS. 4. 6 and 7. Therefore, high speed processing of the CPU 12 is not necessary as compared with a case where the window processing is performed through software processing. Thus, it is possible to operate the CPU 12 with a relatively small power consumption. As a result, even when the data processor 2 is driven by the battery 25, preferable window display can be provided.

As described above, according to the present invention, since the structure in which window processing is performed is implemented by hardware, the window display processing can be implemented with very low power consumption as compared with a case it is implemented by software. Even in a display control circuit driven by the battery, the window display function can be implemented.

While only certain presently preferred embodiments have been described in detail, as will be apparent with those skilled in the art, certain changes and modifications can be made without departing from the scope of the invention as defined by the following claims.

What is claimed is:

1. A display control circuit comprising:

window coordinate data storing means for storing window coordinate data which specifies a window region in a display portion of a displaying means for displaying an image in accordance with address data and display data input to the display means;

mask data generating means responsive to said window coordinate data storing means for generating binary valued mask data words, wherein each bit of a mask data word corresponds to one display character of a plural character display region of said display portion, for distinguishing each said character as to whether it is located within or outside the window region in accordance with the address data and the window coordinate data;

operating means for generating display data input to the displaying means by logically combining the mask data and the display data corresponding to every address data input to the displaying means; and wherein the mask data generating means comprises subtracting means for obtaining a difference between the address data and the window coordinate data and generates the mask data in accordance with the difference so as to indicate whether the plural character display region is wholly within or outside the window, or is partially within the window.

2. A display control circuit as set forth in claim 1, wherein the address data and the display data are supplied from a CPU.

3. A display control circuit as set forth in claim 1, wherein the displaying means is a liquid crystal display.

4. A display control circuit as set forth in claim 1, wherein the address data and window coordinate data are shown in X-Y rectangular coordinates set in the display region.

5. A display control circuit as set forth in claim 4, wherein the window region is rectangular and the window coordinate data is designated by coordinates ($X_1$, $Y_1$) and ($X_2$, $Y_2$) of two opposite tops in the window region.

6. A display control circuit as set forth in claim 5, wherein the mask data generating means comprises subtracting means for obtaining a difference between the address data (X, Y) and the window coordinate data ($X_1$, $Y_1$) and ($X_2$, $Y_2$) and generates the mask data which shows that the address data (X, Y) exists in the window region when $X_1 > X_2$, $Y_1 > Y_2$ and $X_1 > X > X_2$, $Y_1 > Y > Y_2$.

7. A display control circuit as in claim 1, wherein said window coordinate data storing means stores window coordinate data for specifying a plurality of window regions and said mask data generating means generates binary valued mask data words for distinguishing display characters from each window region.

8. A display control circuit as in claim 7, wherein some of said window regions superimpose others of said window regions.

9. A display control circuit as in claim 8, wherein the binary valued mask data words for each plural character display region within superimposed windows are logically combined to form a combined binary valued mask data word.

* * * * *